US005454449A

United States Patent [19]

Mäkimattila et al.

[11] Patent Number: 5,454,449

[45] Date of Patent: Oct. 3, 1995

[54] WALL STRUCTURE FOR AN ELEVATOR, AND AN ELEVATOR CAR

[75] Inventors: Simo Mäkimattila, Helsinki, Finland; Hugh Raymond, Middlesex, United Kingdom

[73] Assignee: Kone Elevator GmbH, Baar, Switzerland

[21] Appl. No.: 113,304

[22] Filed: Aug. 30, 1993

[30] Foreign Application Priority Data

Sep. 4, 1992 [FI] Finland ..... 923957

[51] Int. Cl.[6] ..... B66B 11/02

[52] U.S. Cl. ..... 187/401

[58] Field of Search ..... 187/1 R, 401

[56] References Cited

U.S. PATENT DOCUMENTS

| | | | |
|---|---|---|---|
| 4,357,993 | 11/1982 | Halpern et al. | 187/1 R |
| 4,700,809 | 10/1987 | Lazar | 187/1 R |
| 5,080,003 | 1/1992 | Kappeler | 187/1 R X |

FOREIGN PATENT DOCUMENTS

| | | | |
|---|---|---|---|
| 1149995 | 7/1957 | France | 187/1 R X |
| 1294188 | 11/1989 | Japan | 187/1 R X |
| 3288788 | 12/1991 | Japan | 187/1 R X |
| 4116083 | 4/1992 | Japan | 187/1 R X |
| 1495610 | 12/1977 | United Kingdom . | |

*Primary Examiner*—William E. Terrell
*Assistant Examiner*—Dean A. Reichard

[57] ABSTRACT

A wall, ceiling or floor for an elevator car and to an elevator car in which these items are used has a specific structure. The structure includes sheets having on one side, at opposite edges, edge parts oriented in a direction differing from that of a sheet surface, adjacent sheets being attached to each other by attachment surfaces formed in the edge parts (3,4). The other sides of the sheets i. e. the sides opposite to the edge parts, are arranged to form a continuous exterior surface of the elevator car, an interior wall element forms an interior surface of the elevator car and is attached to the edge parts of the sheets (1).

16 Claims, 3 Drawing Sheets

WALL STRUCTURE FOR AN ELEVATOR, AND AN ELEVATOR CAR

BACKGROUND OF THE INVENTION

The present invention relates to a wall structure for an elevator and to the structure of an elevator car that includes a ceiling, floor, at least two walls and a doorway.

The car unit of an elevator consists of the car proper and a car frame possibly provided to support the elevator car. The elevator car should provide a sufficient and safe travelling space for the users of the elevator. In the design of the elevator car, it is also necessary to consider the special requirements imposed by the fact that the car moves in an elevator shaft.

At present, the walls of an elevator car are manufactured from profiled sheets attached to each other by inflections perpendicular to the sheet surface. On the side facing the car interior, the sheet structure has a substantially smooth surface, to which the wall panels or other elements forming the interior wall surface of the car are attached. The exterior wall of the car consists of the sheets and their inflections, which protrude from the wall toward the elevator shaft. The sheet surfaces forming the exterior wall of the car are lined with damping material.

The wall, ceiling and floor structures of the elevator car have to receive the forces applied to the car during its travel. The noises originating from the elevator shaft have to be damped as much as possible to ensure a good travelling comfort. Due to its low mass per unit area, a wall composed of thin sheet metal has only a modest sound insulating capacity, especially in the case of low frequencies (f<500 Hz).

The case-specific requirements regarding the interior decoration and the techniques used in each elevator vary greatly and fulfilling those requirements should be as easy as possible. Generally it is required that the surface material of the walls of the elevator car be architecturally compatible with the materials used in the interior decoration of the building.

SUMMARY OF THE INVENTION

The object of the invention is to produce a new wall structure for an elevator car which is suited for use with different solutions for interior decoration of the car and which meets the requirements imposed on elevator cars. To achieve this, the wall structure of the invention in one embodiment there are two sheets each having on one side at least two opposite edges. The edge parts are oriented in a substantially different direction than that of a sheet surface. Adjacent sheets are attached to each other by an attachment surface formed in the edge parts. The sides opposite to the edge parts are arranged to form a continuous exterior surface of an elevator car and at least one interior element forming an interior surface of the elevator car is fitted to be attached to the edge parts of the sheets. The elevator car of the invention In one embodiment, at least one wall of the element contains at least two sheets forming an exterior wall of the car. The sheets are attached to each other by edge parts formed at opposite edges of the sheets. These edge parts are oriented in a direction substantially different than that of a surface of the sheets and there is at least one interior wall element attached to the edge parts of the sheets.

With the structure of the invention, the exterior car surface facing the elevator shaft is substantially smooth. The aerodynamic noise generated by the moving car is low without special arrangements. In applications where the exterior wall of the car is visible, e.g. in glass shafts, the outside of the elevator car need not be separately panelled.

The hollow structure of the invention forms a closed bending profile which is rigid. The elevator car constitutes a large proportion of the movable mass of the elevator, and the aim is to design the car so that its weight is close to the low bound required by the friction of the traction sheave and the ropes. Although the weight can be compensated by the mass of the counterweight, increasing the counterweight mass is uneconomic and reduces the mechanical efficiency of the elevator.

The box structure is easy to fill with noise damping material and provides a combination of insulation against airborne noise, weight per unit area and characteristic rigidity that is better than with the wall structures currently used in elevator cars. Unlike previously known solutions, the wall structure of the invention effectively absorbs noise even at low frequencies. Those parts of an elevator car that are subject to load strain are generally manufactured from cold rolled sheet steel, and such structures characteristically have a poor damping capacity expressly in the case of low frequencies.

The decorative panel forming the .interior surface of the structure of the invention is easy to replace with a new one. For example during construction work, the panel can be turned to the other side of the wall structure. In this case, symmetrical joining methods have to be used to allow the wall elements to be rotated about the vertical axis. Alternatively, for use during construction, the panels can be mounted by temporary means. The materials of the interior car wall and of the decorative surface to be attached to it can be so selected that they have thermal expansion characteristics corresponding to each other.

Inside the box structure it is possible to mount the necessary devices for electrification, ventilation and illumination. The box structure of the invention is also suited for use in the ceiling and the floor if the material thickness and the profile height are modified so as to meet the requirements relating to these parts.

DESCRIPTION OF PREFERRED EMBODIMENTS

Figure 1:
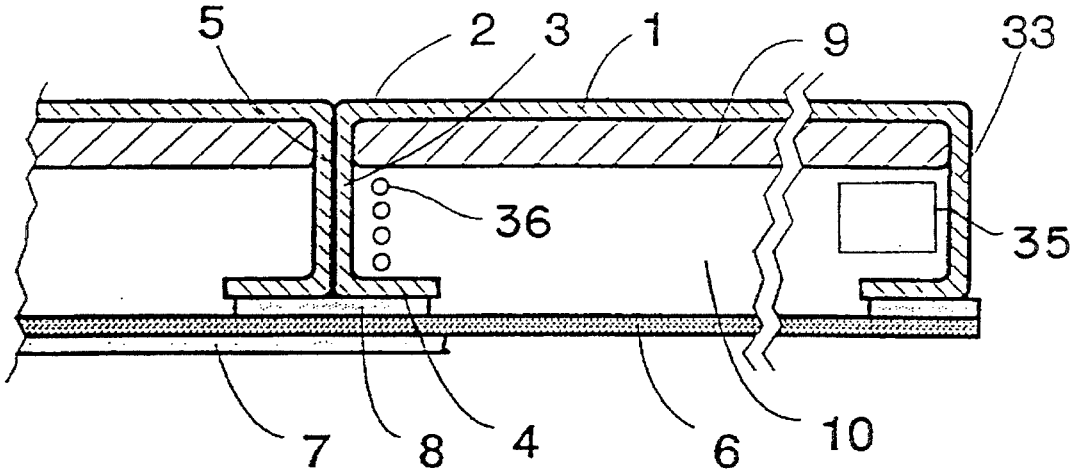
FIG. 1 illustrates a wall structure according to the invention.

FIG. 1 illustrates the wall structure for an elevator car according to the invention. The structure consists of adjacent sheets 1 with their edges bent so as to form inflections 3 substantially perpendicular relative to the level surface of the sheet 1, said inflections being placed against each other. Depending on the application, the outer surface of the sheet 1 is not necessarily straight but may also have a curved shape if the elevator has a curved exterior surface. In this case the inflections 3 may be other than rectangular. One or both edges of the sheet are further bent to form flanges 4 that are essentially parallel to the interior wall of the car, the interior wall elements 6 being attached to said flanges. The sheets 1 are made of metal. The elements 6 may consist of wood fibre board, thermoplast, metal or other suitable material that meets the requirements regarding elevator materials. Weighty decorative materials, such as stone, marble and mirror surfaces, can be attached to the wall elements in the form of thin, large plates according to the architectural requirements.

The inflections 3 constitute edge parts by which adjacent sheets are fixed together by means of a welded or crimped joint 5. The edge parts can also be manufactured as separate parts which are fixed with corresponding joints to that side of the sheet 1 which faces the interior of the car, although in this case the technical advantage in manufacture resulting from the use of a single sheet will be lost. The interior wall elements 6 are attached to the flanges 4 with glue or tape 8. The elements can also be fixed with screws, retaining pins 12 (FIG. 2) or some other type of joint. The interior wall element 6 is coated with a decorative material 7 suited for the elevator car, such as paint, a glued coat or equivalent.

The sheet 1 with its edge parts consisting of the bent edges 3 and 4, and the interior wall element 6 form a box structure with a cavity 10 inside it. In the cavity, can be placed ventilation pipes 35, wires 35 and wires 36. Inside the box structure, the sheet surface facing towards the elevator car is lined with fireproof sound insulating material 9. If desirable, the whole cavity 10 can also be filled with sound insulating material.

In this wall structure, all sheets 1 forming the exterior surface are bent at their edges to form inflections 3 and flanges 4. Thus, the inflections 33 at the extreme edges of the structure form the side edges of the wall structure. The whole wall structure consists of closed boxes and has a rigid bending profile. The metallic cross-section of the profile is far removed from the reference line of bending of the profile.

Although in the above description the structure of the invention has been referred to as a wall structure, a corresponding construction can be used in the same way to produce floor or ceiling structures. In this case, the materials and material thicknesses used are determined accordingly.

Figure 2:
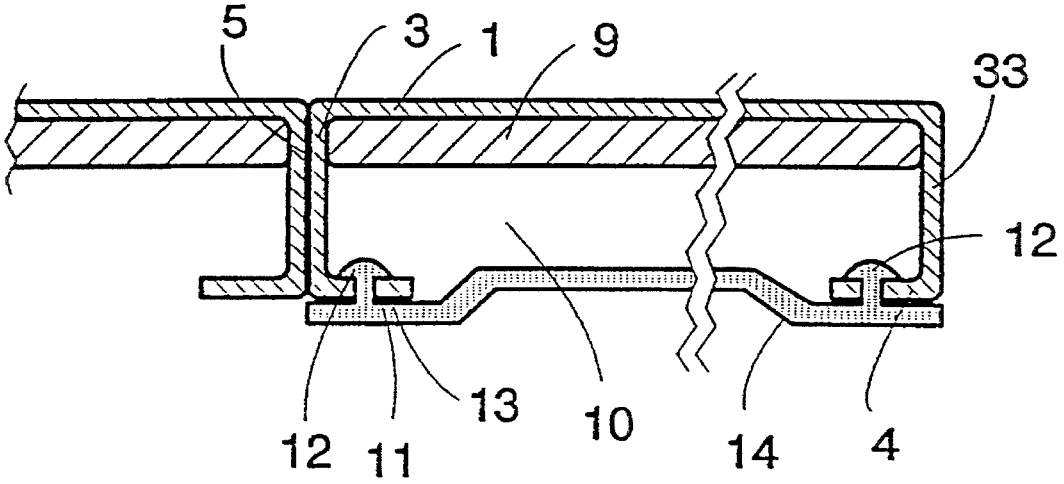
FIG. 2 illustrates another wall structure according to the invention.

FIG. 2 illustrates another solution for the structure and fixing of the interior wall element. The same parts are indicated by the same reference numbers as in FIG. 1. The interior wall element 14 is a panel of vacuum moulded ABS or PC plastic with suitable bends. The element is provided with retaining pins 12 which can be fitted into holes 11 made in the flanges 4 of the sheet 1. A damping or sealing strip 13 is placed between the flanges 4 and the interior wall element 14.

Figure 3B:
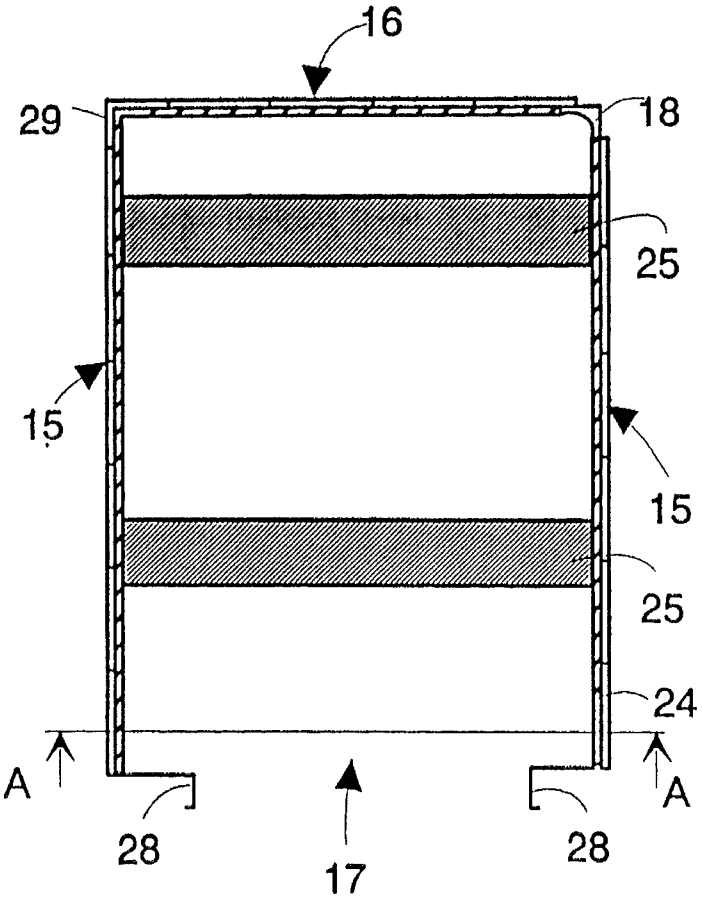
FIGS. 3(*a*) and 3(*b*) present elevator car according to the invention, and FIG. 4 (present) a detail of the joint between the wall element and the ceiling.
Figure 3A:
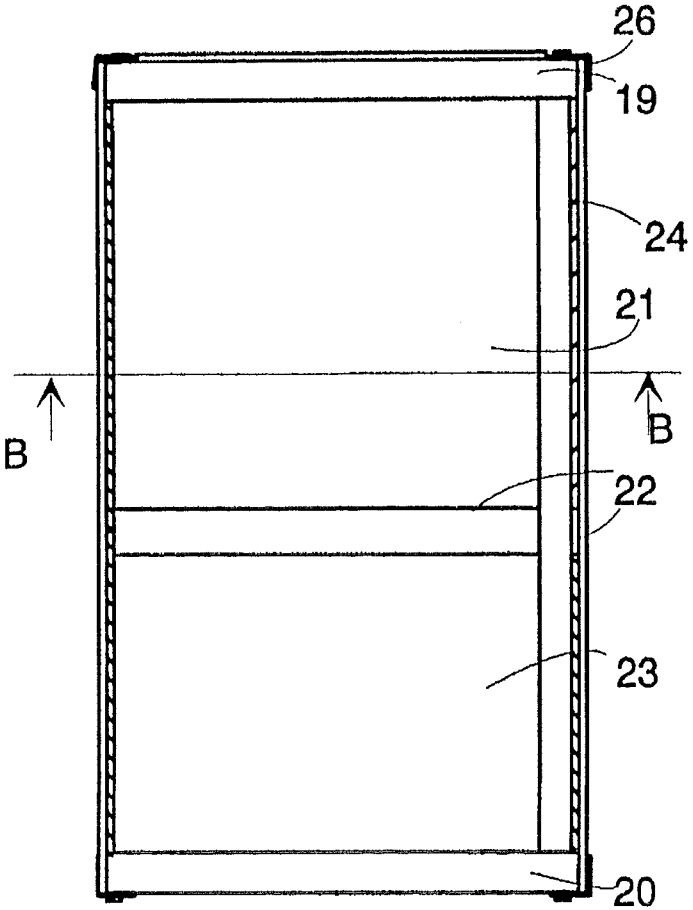

FIGS. 3(*a*) and 3(*b*) illustrate an elevator car implemented using the structure of the invention. FIG. 3*a*) illustrates a sectional view A—A of the elevator car as seen from the side of the doorway, and FIG. 3*b*) illustrates a sectional view B—B as seen from below. The elevator car comprises side walls 15 and a rear wall 16, which have been constructed using wall structures according to the invention. The fourth wall consists of the doorway 17, a door (not shown) fitted in it, and door jambs 28. The side wall 15 is attached to the rear wall 16 by means of a curved 18 or a rectangular 29 corner piece. The wall structures are attached to the ceiling 19 and to the floor 20 by means of a fastening element 26 as shown more clearly in FIG. 4. The floor and the ceiling may also be constructed of box structures. The side and rear walls consist of an upper wall panel 21, a handrail 22 and a lower wall panel 23. The material and coating used in these may be any material usable in an elevator car. Part of the wall area consists of a box 24 for signalling and other devices. The wall elements may be of a height and width equal to those of the wall itself, or the wall may be composed of several similar or different parts. When the wall elements are provided with fixing points placed at standardized locations, replacing elements will be easy. For example, the upper wall panel may be a mirror. The empty spaces in the box structures of the ceiling and walls may accommodate electrical devices and illumination and ventilation equipment and the required wiring. Part of the ceiling surface consists of illuminators 25.

Figure 4:
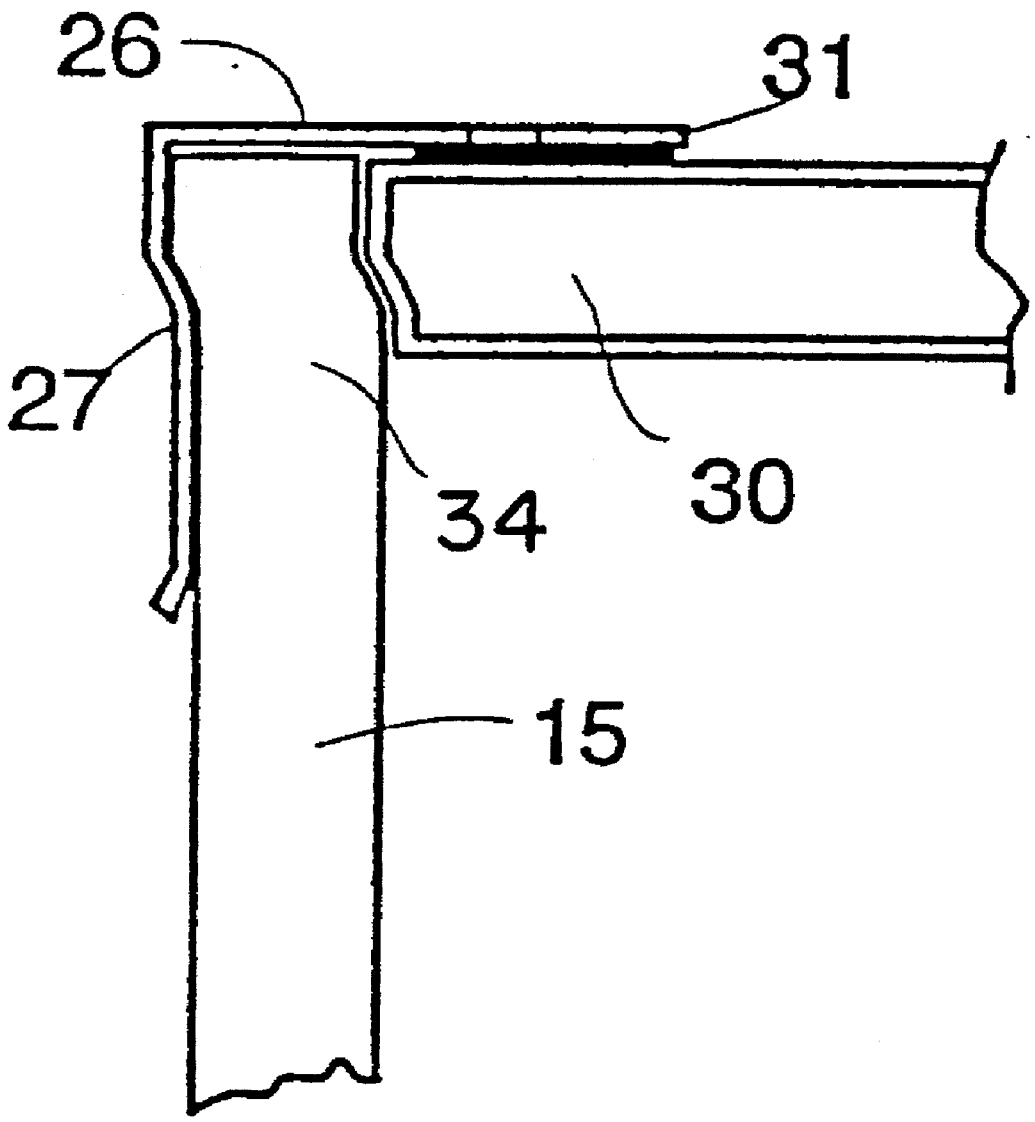

FIG. 4 shows how the wall structure is fastened to the ceiling. Welded to the ceiling element 30 at point 31 is an angular spring profile 26 so that one flank 27 of the profile is at a distance from the ceiling element 30, leaving between the wall structure and the ceiling element a mounting slot 34 of a width equal to the thickness of the wall structure 15. In a corresponding manner, the floor is provided with a mounting slot into which the wall structure 15 can be fitted. The wall structure can be mounted in place by moving the ceiling element in the vertical direction. The wall structure can be mounted with either side out. When the elevator is used during construction work, the wall surface of the car can be protected without separate protective measures by turning it the other way round.

The invention has been described above by the aid of one of its preferred embodiments. However, the presentation is not to be regarded as limiting the invention, but instead the embodiments of the invention may vary within the limits defined by the following claims.

We claim:

1. A wall, ceiling or floor structure for an elevator car, comprising:

at least two sheets, each sheet having on one side, at least two opposite edges, an edge part oriented in a direction substantially differing from that of a sheet surface, in which structure adjacent sheets are attached to each other by attachment surfaces formed in the edge parts, said attachment surfaces being continuous and uninterrupted and means for permanently bonding said attachment surfaces to each other, sides opposite to the edge parts, are arranged to form a continuous exterior surface of the elevator car; and at least one interior wall element forming an interior surface of the elevator car is fitted to be attached to the edge parts of the sheets.

2. The structure according to claim 1, wherein the edge parts of each sheet include inflections of its edges substantially perpendicular to the direction of a surface of the sheet, said inflections being further bent inward to form flanges essentially parallel to the interior wall element, to which flanges the interior wall element of the elevator car is attached.

3. The structure according to claim 1, wherein the sheet forming the exterior wall of the car together with its edge parts and the interior wall element constitute at least one closed hollow structure.

4. A wall, ceiling or floor structure for an elevator car, comprising:

at least two sheets, each sheet having on one side, at least two opposite edges, an edge part oriented in a direction substantially differing from that of a sheet surface, in which structure adjacent sheets are attached to each other by attachment surfaces formed in the edge parts, sides opposite to the edge parts, are arranged to form a continuous exterior surface of the elevator car; and at least one interior wall element forming an interior surface of the elevator car is fitted to be attached to the edge parts of the sheets wherein the sheet forming the exterior wall of the car together with its edge parts and the interior wall element constitute at least one closed hollow structure which is filled with insulating material at least in an area lying next to the sheets.

5. An elevator car comprising:

a ceiling, a floor, at least two walls and at least one doorway;

at least one wall contains at least two sheets forming an exterior wall of the car, said sheets being attached to each other by edge parts formed at opposite edges of the sheets and oriented in a direction substantially differing from that of a surface of the sheets, and at least one interior wall element attached to the edge parts of the sheets, wherein the sheets with their edge parts and interior wall element form a hollow structure.

6. The elevator car according to claim 5, wherein the hollow structure is at least partially filled with damping material.

7. The elevator car according to claim 5 wherein the floor of the elevator car consists of sheets forming an exterior surface, said sheets being attached to each other by edge parts formed at the edges of the sheets and oriented in a direction substantially differing from that of a surface of the sheets, and at least one element forming an interior surface and attached to the edge parts of the sheets.

8. The elevator car according to claim 5, wherein the floor and the ceiling of the elevator car are provided with mounting slots, in which the wall structure of the elevator car is fitted.

9. The elevator car according to claim 5, wherein wiring required by electrification and ventilation of the elevator car is placed in a cavity of the wall structure, and that illuminating and signalling devices with their boxes and frames form a part of a surface of the interior wall.

10. The elevator car according to claim 5, wherein the ceiling of the elevator car consists of sheets forming an exterior surface, said sheets being attached to each other by edge parts formed at the edges of the sheet and oriented in a direction substantially differing from that of a surface of the sheets, and at least one element forming an interior surface and attached to the edge parts of the sheets.

11. The elevator car according to claim 7, further including a ceiling of the elevator car that consists of sheets forming an exterior surface, said sheets being attached to each other by edge parts formed at the edges of the sheets and oriented in a direction substantially differing from that of a surface of the sheet, and at least one element forming an interior surface and attached to the edge parts of the sheets.

12. The structure according to claim 1, wherein said means is a weld bond.

13. The structure according to claim 1, wherein said means is a crimp bond.

14. The elevator car according to claim 5, wherein the edge parts attached to each other are attachment surfaces that are continuous and uninterrupted; and means for permanently bonding said attachment surfaces to each other.

15. The structure according to claim 14, wherein said means is a weld bond.

16. The structure according to claim 14, wherein said means is a crimp bond.

* * * * *